United States Patent [19]

Sakurai et al.

[11] Patent Number: 4,736,206

[45] Date of Patent: Apr. 5, 1988

[54] WINDSHIELD GLASS FOR A VEHICLE, HAVING HEATING CONDUCTIVE WIRES AND ANTENNA WIRES

[75] Inventors: Kaoru Sakurai, Kawasaki; Harunori Murakami, Machida, both of Japan

[73] Assignee: Nippon Sheet Glass Co., Ltd., Osaka, Japan

[21] Appl. No.: 787,169

[22] Filed: Oct. 15, 1985

[30] Foreign Application Priority Data

Oct. 22, 1984 [JP] Japan ..... 59-221598

[51] Int. Cl.[4] ..... H01Q 1/32; H01Q 1/02

[52] U.S. Cl. ..... 343/704; 343/713

[58] Field of Search ..... 343/704, 713, 711, 712

[56] References Cited

U.S. PATENT DOCUMENTS 4,260,989 4/1981 Ishii et al. ..... 343/704

4,491,844 1/1985 Tsuchie et al. ..... 343/704

FOREIGN PATENT DOCUMENTS 0148405 9/1982 Japan ..... 343/704

*Primary Examiner*—William L. Sikes

*Assistant Examiner*—Doris J. Johnson

*Attorney, Agent, or Firm*—Dennis J. Williamson

[57] ABSTRACT

Windshield glass for a vehicle is disclosed including heating conductive wires for defogging and antenna wires for receiving a radio wave. The reception signal of the antenna is derived from an output at the center of the windshield glass and is led out through a lead wire to a feeding point positioned at a side portion of the windshield glass. A pair of auxiliary elements extends over a whole length of upper and lower sides of the lead wire. The auxiliary elements are connected to one of a pair of power supply buses of the heating conductive wires for removing influence of the lead wire on reception characteristics of the antenna.

7 Claims, 4 Drawing Sheets

WINDSHIELD GLASS FOR A VEHICLE, HAVING HEATING CONDUCTIVE WIRES AND ANTENNA WIRES

BACKGROUND OF THE INVENTION

1. Field of the Invention:

The present invention relates to a windshield glass for a vewhicle which comprises an antenna element for receiving a radio or TV signal.

2. Description of the Prior Art:

Conventionally, a rear windshield glass provided with a plurality of heating conductive wires for defogging and an antenna wire for receiving radio or TV signals is known. Although such a glass antenna for a vehicle can relatively sensitively receive medium frequency waves, it is insufficient reception sensitivity (gain) with respect to ultrashort waves such as FM waves and has a poor S/N ratio of a reception signal.

For example, glass antennas having conductive patterns shown in FIGS. 1A and 1B are conventionally used. As shown in FIGS. 1A and 1B, a heating conductive wire group 2 for defogging is provided on a rear windshield glass 1 of a vehicle, and a heating current is supplied thereto through buses 3 and 4. An antenna wire 5 for receiving very high frequency such as FM waves is provided above the conductive wire group 2 parallel thereto, and a reception signal is derived from a feeding point 6 provided substantially at the center of the wire 5.

The heating conductive wire group 2 is also used as an antenna for the medium frequency band. For this purpose, the uppermost wire of the heating conductive wire group 2 is connected to the antenna wire 5.

The antenna wire 5 shown in FIG. 1A is a single element type, and one end of a single antenna element **5*a* extending in the horizontal direction is connected to the heating conductive wire group 2 through a coupling wire 5*b*. FIG. 1B shows a modification of the antenna pattern shown in FIG. 1A, in which in order to enhance a reception gain, a part 5*a*' of the element 5*a* extends along the uppermost stage of the heating conductive wire group 2**.

The antenna patterns shown in FIGS. 1A and 1B are of center feeding point type. The pattern shown in FIG. 1B, for example, provides a relatively high sensitivity, as shown in a reception level graph of FIG. 2. The ordinate of FIG. 2 indicates an average reception level AVE within the entire azimuth range of the antenna.

However, in the case of a center feeding point type antenna, a feeder line in a vehicle must be extended to an upper central portion of the windshield glass 1. It causes a problem in mounting the feeder line.

As shown in FIGS. 3A to 3C, another type of antenna pattern in which the feeding point 6 is shifted to a side portion of the windshield glass 1 through a lead wire **5*c* is proposed. In this type, as shown in FIG. 3A, when the feeding point 6 is simply provided at the side portion, the effective length of the antenna element is changed due to the lead wire 5*c* and sensitivity is lowered, as shown in a reception level graph shown in FIG. 4. Variations in frequency characteristics, however, are suppressed as compared to that of FIG. 2** and the reception level is stabilized.

In order to improve sensitivity of the antenna of FIG. 3A, the lead wire **5*c* is provided near along a glass edge from the center of the antenna element 5*a* to the feeding point 6. Thus, the lead wire 5*c* is AC coupled to a body (ground potential) of a vehicle, and reception characteristic is compensated, thus reducing an influence of the lead wire 5*c* on sensitivity. However, the lead wire 5*c*** is concealed in a weatherproof strip of the glass edge, and may be disconnected due to electrical corrosion by water over a long period of time.

Referring to FIG. 3B, a multifolded wire **5*b* is used for adjusting the length of the element, which corrects the reception characteristics. In this case, however, in order to obtain a required length of the element, a distance between each two adjacent folded portions of the multifolded wire 5*d*** becomes narrow, and AC coupling occurs therebetween. Thus, an expected effect in adjustment of the length cannot be obtained.

Referring to FIG. 3C, an earth element 7 is provided along the lead wire **5*c* so as to correct the characteristics, and an influence of the lead wire 5*c* applied to the antenna characteristics is reduced. However, an earth terminal 8** is additionally required, resulting in an increased cost.

SUMMARY OF THE INVENTION

The present invention has been made in consideration of the above problems, and has as its object to provide a windshield glass for a vehicle which can improve a sensitivity of an antena pattern of side feeding point type by means of a simple structure and can obtain good frequency characteristics without adding a ground terminal to an antenna pattern or without using an ineffective folded wire.

According to the present invention there is provided a windshield glass for a vehicle, comprising a plurality of heating conductive wires having a power supply bus mounted on the windshield glass for the vehicle to extend in a horizontal direction; an antenna wire extending parallel to the heating conductive wires; a lead wire extending in a lateral direction to connect a reception output from an output point positioned substantially at the center along the lateral direction of the windshield glass to a feeding point positioned at a side portion of the windshield glass; and a pair of auxiliary elements extending over a whole length of upper and lower sides of the lead wire and connected to said power supply bus.

With this arrangement, when the length of an antenna element is changed due to addition of a lead wire to an antenna wire, degradation in reception characteristics can be corrected.

BRIEF DESCRIPTION OF THE DRAWINGS

FIG. 10 is a front view of a rear windshield glass of a vehicle according to a further embodiment of the invention.

DETAILED DESCRIPTION OF THE PREFERRED EMBODIMENTS

Figure 1A:
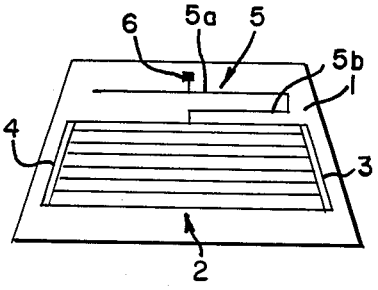
FIG. 1A PRIOR ART
FIGS. 1A and 1B are front views showing conventional antenna patterns of center feeding point type of a rear windshield glass of a vehicle.
Figure 1B:
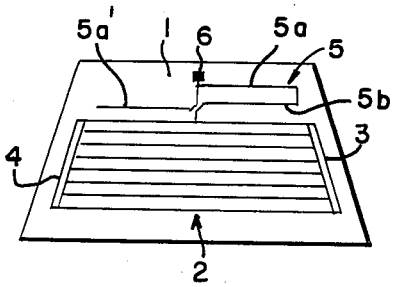
Figure 3A:
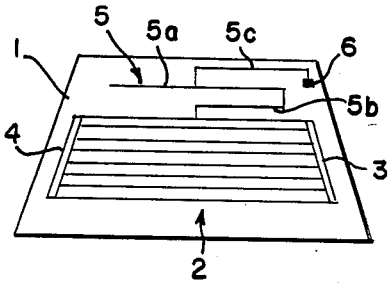
FIG. 3A PRIOR ART
FIGS. 3A, 3B and 3C are front views showing conventional antenna patterns of side feeding point type of a windshield glass likewise those in FIGS. 1A and 1B.
Figure 3B:
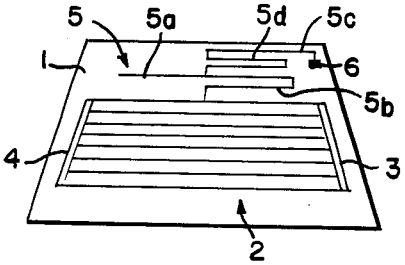
Figure 3C:
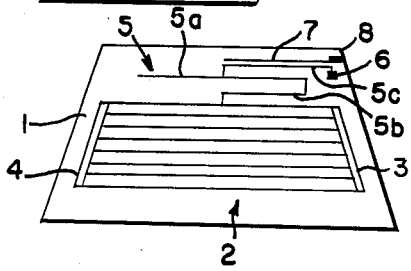
Figure 2:
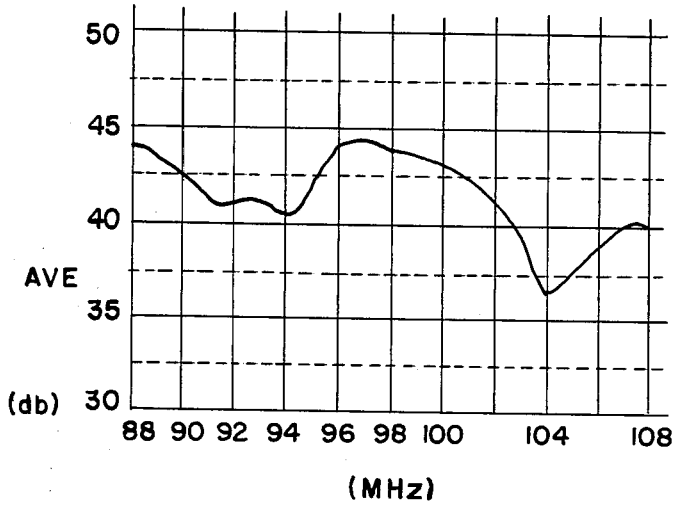
FIG. 2 is a graph showing frequency characteristics of a reception level of the antenna pattern shown in FIG. 1B.
Figure 4:
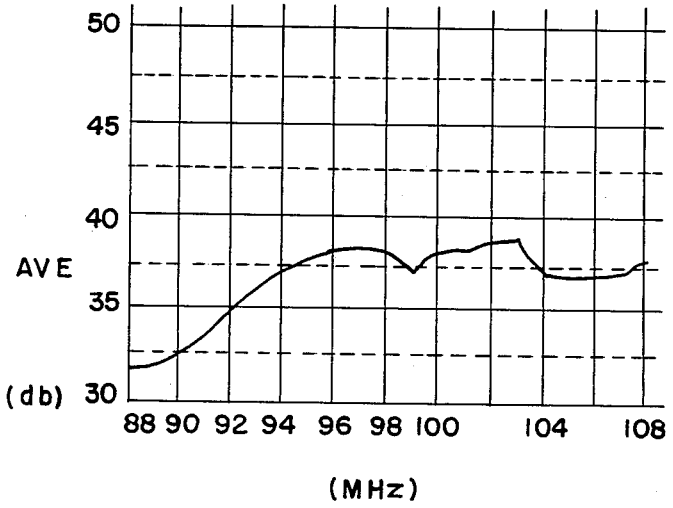
FIG. 4 is a graph showing frequency characteristics of a reception level of the pattern shown in FIG. 3A.
Figure 5:
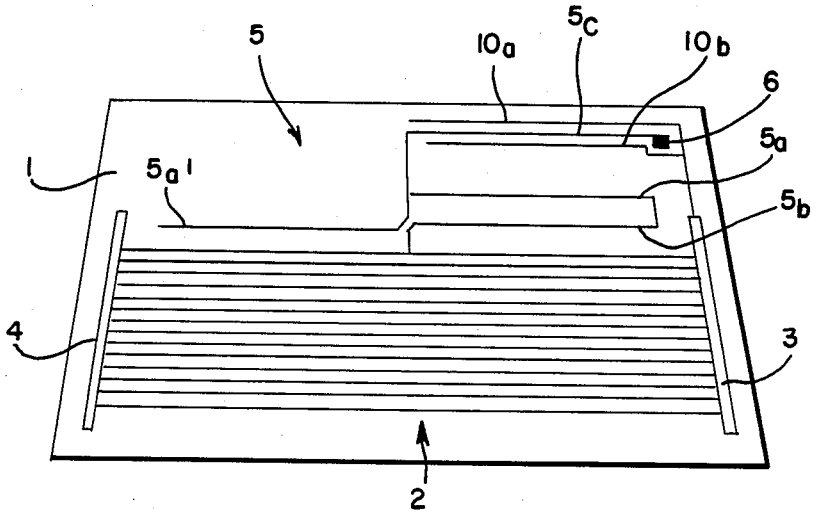
FIG. 5 is a front view of a rear windshield glass of a vehicle according to an embodiment of the present invention.

FIG. 5 is a front view of a rear windshield glass of a vehicle viewing from a compartment of a vehicle according to an embodiment of the present invention. A basic antenna pattern is a conventional pattern shown in FIG. 1B, and the same reference numerals denote the same parts. The pattern is of the center feed type where the antenna wire, shown generally at 5, is connected to the central portion of the uppermost wire of the conductive wire group 2 through a coupling wire 5*b*. The coupling wire 5*b* is disposed parallel to the wires of group 2 and extends from the central portion substantially to the bus 3. The distance between the coupling wire 5*b* and the uppermost wire of the wire group 2 is approximately one sixteenth the length of the coupling wire 5*b*. The antenna element 5*a* of the antenna 5 folds back towards the opposite bus 4 and extends parallel to the coupling wire 5*b*. The antenna element 5*a* is located approximately one eighth the length of the coupling wire 5*b* from the uppermost wire of wire group 2. The antenna wire 5 also comprises a part 5*a*' that extends parallel to the antenna element 5*a* but diverges therefrom at the central portion such that it is located a distance from the uppermost wire of the wire group 2 that is less than the distance between the uppermost wire and the coupling wire 5*b*. In this manner, the uppermost wire and the antenna part 5*a*' are AC coupled. A reception output is connected from a central portion of the antenna pattern to a feeding point 6 provided at a side portion of a windshield glass 1 through a lead wire 5*c* extending in a horizontal direction such that the lead wire 5*c* extends at least a substantial portion of the length of the coupling wire. Auxiliary elements 10*a* and 10*b* are provided at upper and lower sides of the lead wire 5*c* over its whole length. The auxiliary elements 10*a* and 10*b* are connected with each other so as to surround the feeding point 6 at the side portion of the windshield glass 1, and are then connected to one bus 3 of a heating conductive wire group 2. The bus 3 can be regarded to be at the ground potential in a high frequency band.

Figure 6:
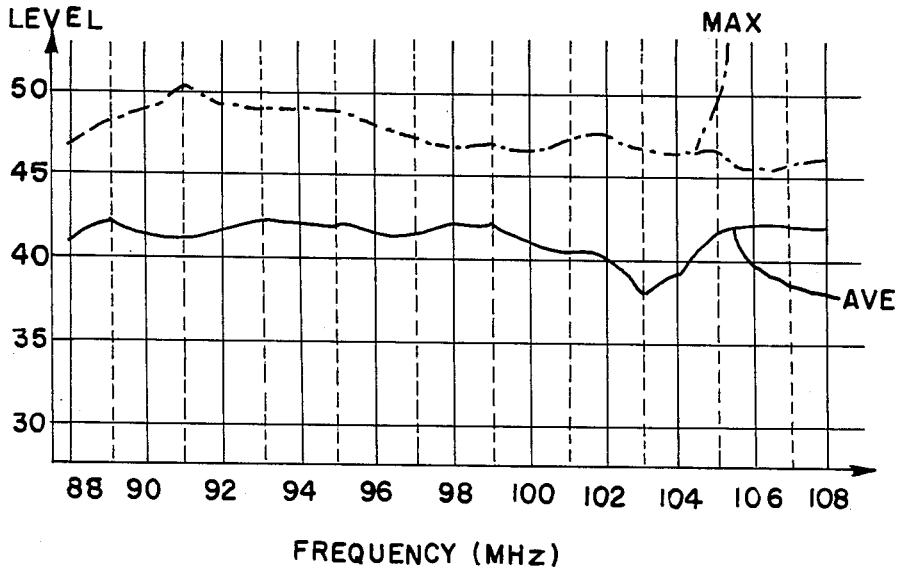
FIG. 6 is a graph showing frequency characteristics of a reception level of the antenna pattern shown in FIG. 5.

When the auxiliary elements 10*a* and 10*b* are provided, a degradation in sensitivity caused by connecting the lead wire 5*c* to an antenna element 5 can be compensated, and as shown in a reception level graph of FIG. 6, high sensitivity reception characteristics can be obtained. A variation in reception sensitivity along a frequency axis (variation in reception level) can be suppressed, and stable reception can be guaranteed in a wide frequency band (88 MHz to 108 MHz).

A solid line in the graph of FIG. 6 represents an average reception level AVE within the entire azimuth range of the antenna, and a dot-dash line represents a maximum reception level MAX in the entire azimuth range.

Figure 7:
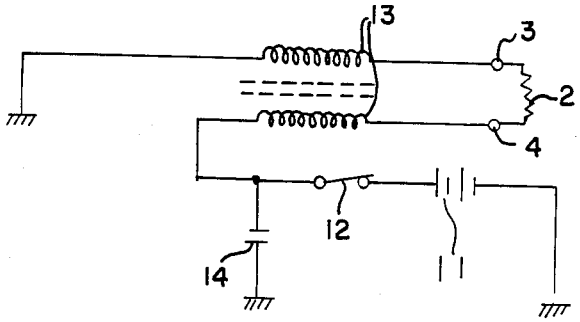
FIG. 7 is a circuit diagram showing a power supply circuit of a heating conductive wire group of FIG. 5.

FIG. 7 is a circuit diagram of a heater circuit. An output voltage from a main battery 11 of a vehicle is connected to a bus 4 of the heating conductive wire group 2 through a switch 12, and a heating current flows from the bus 4 to the bus 3 through the conductive wire group 2. High frequency choke coils 13 exhibiting a high impedance in AM radio frequency band (medium frequency) are interposed between the bus 3 and ground and between the bus 4 and the switch 12 so as to prevent leakage of the reception signal received by the heating conductive wire group 2 toward the ground potential. The choke coil 13 shows a low impedance in FM radio frequency band (VHF), so that the bus 3 can be regarded to be at the ground potential in the FM band. A decoupling capacitor 14 is connected between an output power source line of the switch 12 and ground so as to prevent noises on power lines from interfering in the reception signal.

Figure 8:
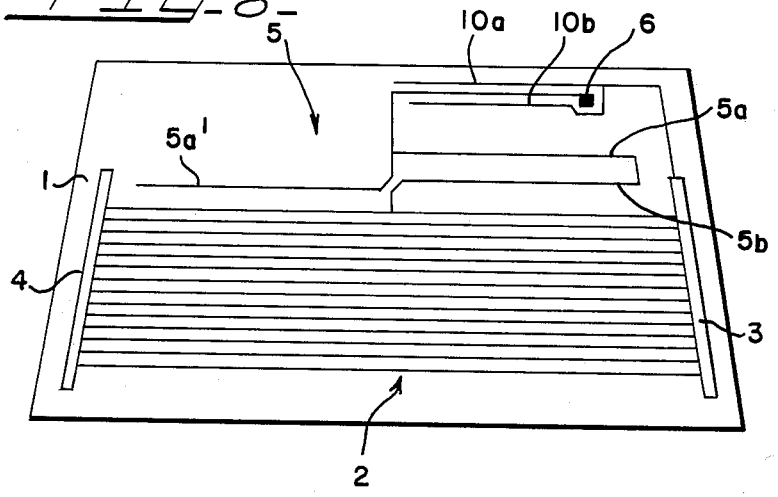
FIGS. 8 and 9 are front views showing modifications of antenna patterns of a windshield glass likewise that in FIG. 5.

FIG. 8 shows a modification of the antenna pattern shown in FIG. 5, and is substantially the same as FIG. 5 except that a position of the feeding point 6 is slightly shifted toward the center. In this modification, the auxiliary elements 10*a* and 10*b* are arranged along upper and lower sides of the lead wire 5*c*, and are connected to the bus 3, thereby obtaining the same effect as in FIG. 5.

Figure 9:
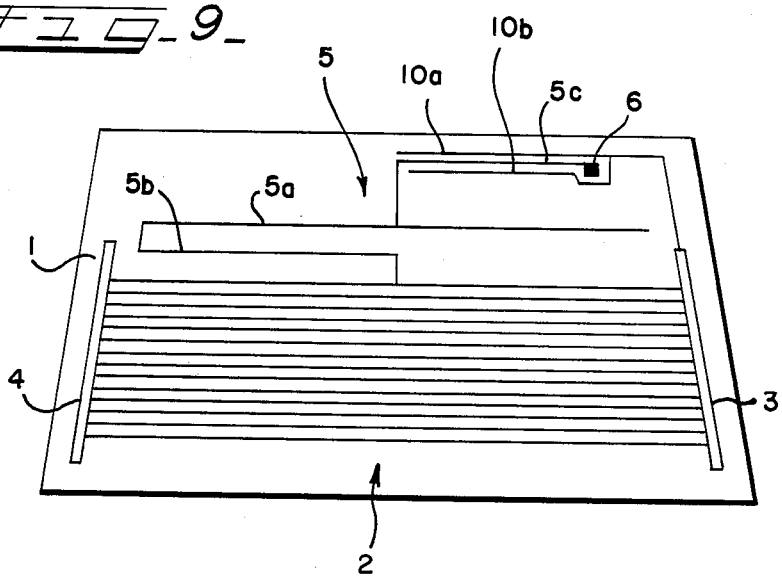

FIG. 9 shows ane mbodiment when the present invention is applied to another antenna pattern. The basic pattern is the pattern shown in FIG. 1A. The antenna pattern is again of the center feed type and consists of an antenna wire, shown generally at 5, coupled to the conductive wire group 2 by a coupling wire 5*b* configured identically to that shown and discussed in regards to the embodiment of FIG. 5. The antenna element 5*a* folds back towards the opposite bus 3 and extends parallel to the coupling wire 5*b* over its entire length. Unlike the pattern of FIG. 5, the entire length of the antenna element is located approximately one eighth the length of the coupling wire 5*b* from the uppermost wire of the wire group 2. In this embodiment, a reception signal is supplied from the center of the antenna element 5 of the basic pattern to the feeding point 6 at the side portion of the windshield glass 1 through the lead wire 5*c*, the lead wire 5*c* is sandwiched between the auxiliary elements 10*a* and 10*b*, and these elements are connected to the bus 3. In this antenna pattern, the same effect as in the above-mentioned embodiment can be obtained.

The heating conductive wires 2, buses 3, 4, antenna elements 5*a*, 5*b*, connecting wire 5*c* and auxiliary elements 10*a*, 10*b* may be formed on the windshield glass by means of a known process comprising a step for printing conductive paste and a step for backing the paste on the windshield glass.

As described above, auxiliary elements are provided along upper and lower sides of a lead wire for supplying a reception output to a feeding point provided at the side of a windshield glass of a vehicle, and can be connected to the power supply bus 4 of the heating conductive wire group, as shown in FIG. 10, rather than to the ground potential bus 3 as previously described. Thus, a degradation in reception characteristics of an antenna caused by addition of the lead wire can be corrected with a simple structure, and a windshield glass antenna having a high sensitivity and flat frequency characteristics can be obtained.

What is claimed is:

1. A windshield glass for a vehicle comprising:

a plurality of heating conductive wires mounted on said windshield glass parallel to one another and extending in a first direction to form a wire group;

an antenna wire extending substantially parallel to said plurality of heating conductive wires;

a coupling wire extending parallel to said plurality of heating conductive wires joining one end of said antenna wire to a central portion of one of said plurality of heating conductive wires;

a power supply circuit connected to said wire group for supplying heating current to said plurality of heating conductive wires;

a lead wire connecting a feeding point to a reception output located at the central portion of said antenna, said feeding point located along an edge portion of said windshield glass such that said lead wire extends to one of the upper corners of said windshield glass for at least half the length of the coupling wire; and a pair of auxiliary elements disposed one each on opposite sides of said lead wire and extending the length of said lead wire, said pair of auxiliary elements meeting at a fork point so as to surround the feeding point and the lead wire, said fork point is further connected to said power supply circuit.

2. A windshield glass for a vehicle according to claim 1, wherein the power supply circuit consists of first and second buses connected one each to the opposite ends of said plurality of heating conductive wires, said first bus also being connected to a ground potential and said second bus also being connected to a power supply.

3. A windshield glass for a vehicle according to claim 2, wherein said auxiliary elements are connected to said first bus.

4. A windshield glass for a vehicle according to claim 2, wherein said auxiliary elements are connected to said second bus.

5. A windshield glass for a vehicle according to claim 3 or 4, wherein a pair of choke coils is connected to power lines respectively between said first bus and the ground potential point and between said second bus and the power supply, said choke coils showing a high impedance in a medium frequency band and low impedance in a very high frequency band.

6. A windshield glass for a vehicle according to claim 1, wherein said antenna wire comprises a first element and a second element both arranged parallel to said heating conductive wires, said first and second elements diverged in opposite directions from a center portion of the windshield glass, said first element being folded back along said heating conductive wires to form said coupling wire and thereby connect the antenna wire to a center portion of the uppermost heating conductive wire.

7. A windshield glass for a vehicle according to claim 6, wherein the second element is disposed more closely adjacent the heating conductive wires than said coupling wire so as to be AC coupled with said heating conductive wires.

* * * * *